US011673736B1

(12) United States Patent
Liu et al.

(10) Patent No.: US 11,673,736 B1
(45) Date of Patent: Jun. 13, 2023

(54) PACKING SYSTEMS AND METHODS FOR SHIPPING PALLET TRUCK VEHICLES

(71) Applicant: ZHEJIANG E-P EQUIPMENT CO., LTD., Huzhou (CN)

(72) Inventors: Peng Liu, Huzhou (CN); Quangao Yu, Huzhou (CN); Jinsong Cao, Huzhou (CN); Xincai Wang, Huzhou (CN); Dongdong He, Huzhou (CN)

(73) Assignee: ZHEJIANG E-P EOUIPMENT CO., LTD.

( * ) Notice: Subject to any disclaimer, the term of this patent is extended or adjusted under 35 U.S.C. 154(b) by 0 days.

(21) Appl. No.: 17/733,205

(22) Filed: Apr. 29, 2022

(51) Int. Cl.

| | |
|---|---|
| ***B65D 85/68*** | (2006.01) |
| ***B65D 88/12*** | (2006.01) |
| ***B66F 9/065*** | (2006.01) |
| ***B65D 6/02*** | (2006.01) |

(52) U.S. Cl.
CPC ..... *B65D 85/68* (2013.01); *B65D 9/06* (2013.01); *B65D 88/121* (2013.01); *B65D 2585/686* (2013.01); *B66F 9/065* (2013.01)

(58) Field of Classification Search
CPC ..... B62B 3/06
See application file for complete search history.

(56) References Cited

U.S. PATENT DOCUMENTS

| | | | | |
|---|---|---|---|---|
| 8,540,213 | B2 | 9/2013 | Feiquan et al. | |
| 9,475,513 | B2 | 10/2016 | Liu et al. | |
| 9,586,605 | B2 | 3/2017 | He et al. | |
| 9,718,661 | B1 | 8/2017 | Hoffman | |
| D805,712 | S | 12/2017 | Qichen et al. | |
| 9,840,350 | B2 * | 12/2017 | Moran | B65D 19/38 |
| 9,879,765 | B2 | 1/2018 | Hongpeng et al. | |
| 9,908,762 | B1 | 3/2018 | Hongpeng et al. | |
| D819,923 | S | 6/2018 | Qichen et al. | |
| D824,633 | S | 7/2018 | Qichen et al. | |
| 10,014,141 | B1 | 7/2018 | Zheng et al. | |
| 10,093,336 | B2 | 10/2018 | Pan et al. | |
| 10,173,709 | B2 | 1/2019 | Zheng et al. | |
| 10,538,422 | B2 | 1/2020 | Lijian et al. | |
| 10,730,728 | B1 | 8/2020 | Qichen et al. | |
| 10,836,620 | B2 | 11/2020 | Jiandong et al. | |
| 10,913,475 | B2 * | 2/2021 | Kalinowski | B62B 3/06 |
| 2007/0137904 | A1 | 6/2007 | Rose et al. | |
| 2015/0102274 | A1 | 4/2015 | He et al. | |
| 2019/0322509 | A1 | 10/2019 | Jianming et al. | |

* cited by examiner

*Primary Examiner* — Bryon P Gehman
(74) *Attorney, Agent, or Firm* — Cook Alex Ltd.

(57) ABSTRACT

Packing system and method for shipping pallet truck vehicles wherein each vehicle has a front frame configured to be assembled to a rear frame. The packing system includes a first holder that holds a plurality of vehicle rear frames lying on their sides, a second holder that holds a plurality of vehicle front frames having forks with at least a first front frame upright and having the forks facing in a first direction, and holds at least a second front frame inverted and having the forks facing in an opposed second direction, and wherein the first holder holding the plurality of rear frames is disposed within the second holder vertically between the forks of the upright at least one first front frame and the forks of the inverted at least one second front frame.

26 Claims, 15 Drawing Sheets

PACKING SYSTEMS AND METHODS FOR SHIPPING PALLET TRUCK VEHICLES

TECHNICAL FIELD

The present disclosure relates to the technical field of carriers, in particular to carriers in a configuration of pallet truck vehicles, and to packing systems and methods for shipping such vehicles.

BACKGROUND ART

Electric carriers in the form of typical pallet truck vehicles generally include components to lift and lower loads, and to power and steer such vehicles while driving forward and rearward. It is common for the vehicles to have a front portion, referred to herein as a front frame, that is connected to a rear portion, referred to herein as a rear frame. The front frame and rear frame constitute the main frame structure of the vehicle for lifting and transporting loads on the vehicle.

The front frame commonly includes forks on which a load may rest, with a connecting rod assembly connected to wheels near the front of the forks. The connecting rod assembly is used to lift and lower the forks, relative to the wheels of the front frame. At present, at least one battery, a hydraulic station, a controller and other components will be assembled and provided in a carriage of a front frame of a conventional electric carrier.

Such vehicles tend to include a rear frame having a motor that drives a drive wheel, and a hydraulic cylinder for lifting the front frame relative to the rear frame. When lifting the front frame, high-pressure oil from the hydraulic station in the front frame will be driven into the hydraulic cylinder in the rear frame, through an oil pipe. The rear frame also typically includes an operator handle to steer the vehicle by changing the direction of the drive wheel, while having operator switches or other controls that are electrically connected to actuators and may be manipulated to control lifting and lowering the front frame and its forks, as well as driving in forward and/or rearward directions. Such vehicles typically require hydraulic oil pipe or tubing connections and electrical wiring harness connections between components in the respective front and rear frames. Given the need for such connections, it is common to completely assemble a vehicle at the point of manufacture for purposes of shipping and use of a fully assembled vehicle. Such vehicles do not have front and rear frames that are conveniently detached and reassembled after shipping or after having been fully assembled.

For shipping purposes, fully assembled vehicles often are arranged simply to stand upright, with the operator handle in a connected and upright position. The vehicles may face each other, with the forks interleaved. This results in a relatively large packing configuration in terms of the space occupied in height, length and width for each two vehicles. Alternatively, the handle may be structurally disconnected at its base and located in a horizontal position to reduce at least the height of a vehicle. Still further, in some packing configurations such vehicles with structurally disconnected handles may be arranged in a packing configuration wherein two vehicles face each other, with the forks of one vehicle overlying the forks of another vehicle. With such a packing configuration having the front frames connected to the rear frames and a pair of vehicles facing each other with overlying or stacked forks, the combined length is similar to that of fully assembled vehicles facing each other and having interleaved forks, but there is somewhat of a reduction in width and height. Thus, for prior art pallet truck vehicles arranged within a standard shipping container described further herein and in accordance with the above description, the container typically would hold 60 to 90 vehicles.

Thus, present packing configurations, whether involving fully assembled vehicles or vehicles having a handle structurally disconnected and in a horizontal position, tend to be placed in configurations that require a relatively large amount space within a common shipping container.

SUMMARY

The purpose of the present disclosure is to provide an improved packing system, which is provided, in part, due to a unique ready to assemble carrier configuration. The new carrier configuration is demonstrated with pallet truck vehicles that avoid typical design, assembly, packing and transportation practices, as well as disadvantages associated therewith. The new vehicles include design, assembly and packing that are convenient for buyers to transport in a more compact and cost efficient, partially disassembled configuration, with the vehicle being easy and quick to assemble after shipping.

In order to achieve the above purpose, a main technical solution of the present disclosure is a carrier, in a configuration of a pallet truck vehicle, which comprises a front frame and a rear frame, wherein the rear frame is quickly and conveniently attachable to and detachable from the front frame. This is particularly useful with respect to a further technical solution with respect to a unique packing system that provides a substantially more compact and efficient packing configuration for shipping vehicles.

The vehicles are described in more detail in U.S. Pub. No. 2022/0411244, incorporated by reference herein in its entirety. Relevant to the description herein, each vehicle has a front frame that includes a frame body that provides for removable installation of a power source in the form of at least one battery, and a wheel connecting rod component provided transversely at the bottom of the frame body. The wheel connecting rod component that is connected to wheels near the front of forward extending forks includes a connecting arm at the rear of the wheel connecting rod component. The rear frame comprises an operating handle, a handle joint base, a hydraulic component, a bearing component having a bearing bridge, a controller and a driving assembly. The front frame may be structurally separated from the rear frame for shipping, while remaining ready to assemble by connecting a top of the hydraulic component to the front frame and connecting ends of the bearing bridge to the rear of the wheel connecting rod component.

In the example shown, all of the hydraulic components, the controller and drive assembly are incorporated into the rear frame, while the power source in the form of one or more batteries is insertable into the front frame. Aside from the structural connection of the top of the hydraulic component to the front frame and the ends of the bearing bridge to the rear of the wheel connecting rod component, the only other connection required following shipping is via a wiring harness connection between the power source in the front frame and electrical components of the rear frame, which is not shown for convenience of viewing the other components and structural connections.

In one aspect, a packing system of the present disclosure is provided for shipping pallet truck vehicles wherein each vehicle has a front frame configured to be assembled to a rear frame. The packing system includes a first holder that holds four vehicle rear frames, with each rear frame lying on its side. The packing system includes a second holder that holds a first pair of vehicle front frames having forks with the first pair of front frames in an upright configuration having the respective forks stacked and facing in a first direction, and holds a second pair of vehicle front frames having forks with the second pair of front frames in an inverted configuration having the respective forks stacked and facing in an opposed second direction, and wherein the first holder holding the four vehicle rear frames is disposed within the second holder vertically between the stacked forks of the upright first pair of vehicle front frames and the stacked forks of the inverted second pair of vehicle front frames.

In a second aspect, the present disclosure includes a method of packing pallet truck vehicles in a packing system for shipment, comprising the steps of: providing a plurality of pallet truck vehicles, with each vehicle having a front frame separated from and configured to be assembled to a vehicle rear frame; loading the rear frames of the plurality of vehicles in a first holder that holds each rear frame lying on a side thereof; loading the plurality of front frames in a second holder that holds at least one front frame having forks with the at least one front frame in an upright configuration having the forks of the at least one front frame facing in a first direction, and holds at least a second front frame having forks with the at least second front frame in an inverted configuration having the forks of the at least second front frame facing in an opposed second direction; and wherein the first holder holding the plurality of rear frames is disposed within the second holder vertically between the forks of the upright at least one first front frame and the forks of the inverted at least one second front frame.

By adopting the above technical scheme, the present example may achieve some or all of the following effects and advantages: 1) it is more convenient and faster to assemble a front frame and separate rear frame after shipping; 2) the oil cylinder, controller and driving assembly are within the rear assembly, avoiding hydraulic and some electrical connections that would otherwise need to be made between components in the front and rear frames; 3) the bearing bridge is detachable from and connectable to the wheel connecting rod component for convenience assembly after shipping; and 4) a space and cost efficient packing system and method take advantage of the modular assembly of front and rear frames, breaking the traditional mode of shipping fully assembled vehicles.

BRIEF DESCRIPTION OF THE DRAWINGS

The above-mentioned and other features of the present disclosure, and the manner of attaining them, will become more apparent and will be better understood by reference to the following description of exemplary embodiments of the present disclosure, taken in conjunction with the accompanying drawings, wherein.

Figure 1:
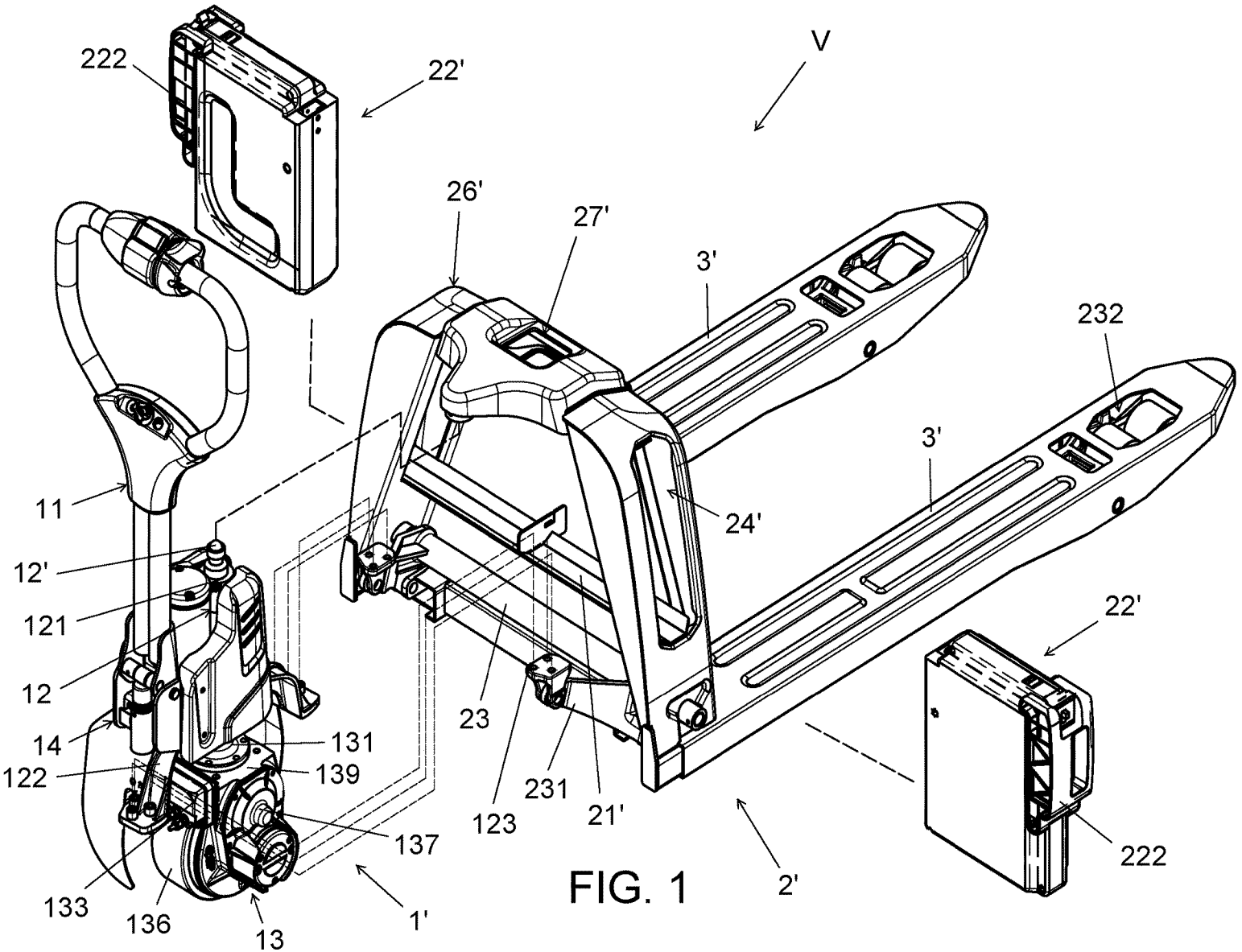
FIG. 1 is a rear perspective structural schematic diagram of an example carrier, in the form of a pallet truck vehicle consistent with the present disclosure, shown in a partially exploded view with a rear frame separated from a front frame and batteries removed from the front frame.
Figure 2:
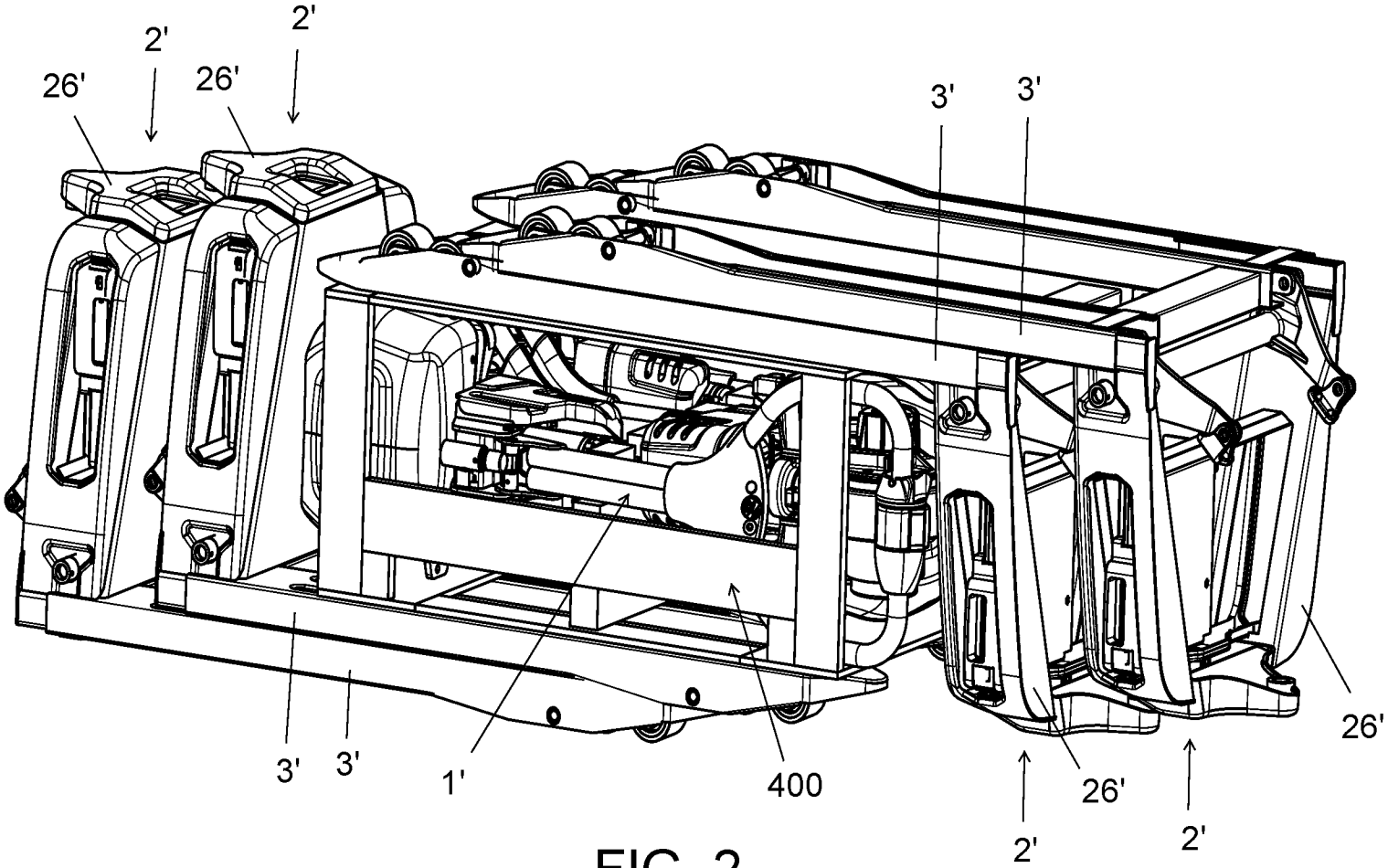
FIG. 2 is a perspective view of a packing configuration of four like vehicles of FIG. 1, with the rear frames separated from the front frames and contained within a first holder located between two stacked front frames facing in a first direction and two inverted stacked front frames facing in an opposed second direction.

Corresponding or related reference numerals indicate corresponding parts throughout the several figures. Although the drawings represent exemplary embodiments of the present disclosure, the drawings are not necessarily to scale and certain features may be exaggerated or removed to better illustrate, view and explain other aspects of the present disclosure.

DETAILED DESCRIPTION OF THE EMBODIMENTS

The following description is used to disclose the present embodiments of carriers in the form of pallet truck vehicles and packing systems for convenient and more cost-efficient shipping of such vehicles in a ready to assemble configuration.

The preferred embodiments of the vehicles and packing systems in the following description are only taken as examples, and other variations consistent with the claims herein may be conceivable by those skilled in the art. The basic principles of the present disclosure defined in the following description may be applied to other embodiments, modifications, and other technical schemes without departing from the spirit and scope of the present disclosure and claims.

It should be understood by those skilled in the art that in the present disclosure the orientation or positional relationship indicated by terms such as, "longitudinal", "transverse", "upper", "lower", "front", "rear", "left", "right", "vertical", "horizontal", "top", "bottom", "inner", "outer", etc. are based on the orientation or positional relationship shown in the drawings, which is only for convenience of describing the present embodiments and simplifying the description, rather than indicate or imply that the claimed device or element must have a specific orientation, be constructed and operated in a specific orientation, such that the above terms should not be understood as limiting the present disclosure or claimed subject matter. It also will be understood that for convenience of viewing structural features of the carriers disclosed, the oil pipe and some other features of the hydraulic component, all of which are within the rear frame, are not shown, which also is the case with respect to the electrical wiring or cabling that connects components within the rear frame and would be connected to at least the power source, such as at least one battery, in the front frame.

It may be understood that the term "one" should be understood as "at least one" or "one or more", that is, in one embodiment, the number of elements may be one, while in other embodiments, the number of the elements may be multiple. Accordingly, the term "one" should not be understood as limiting a number.

As noted previously, examples of the vehicles are described in more detail in U.S. patent application Ser. No. 17/554,890, incorporated by reference herein in its entirety. For purposes of the present disclosure, a brief description of an example pallet truck vehicle with which the present example packing system may be used is provided herein with respect to FIG. 1, which corresponds to the second example embodiment in the aforementioned pending patent application.

In FIG. 1, a carrier in the form of a pallet truck vehicle V comprises a rear frame 1' and a front frame 2', which are effectively modular in that the rear frame 1' is easily and quickly detachable from and attachable to the front frame 2'.

The front frame 2' comprises a frame body 26', a power source in the form of at least one battery structure 22', which in this example includes two identical batteries 22' transversely inserted through openings 24' in the frame body 26'. The frame body 26' is L-shaped with respect to having forward extending forks 3'. The batteries 22' are installed on an installing guide rail 21' on the vertically extending inner front side wall of the frame body 26'. The front frame 2' also includes a wheel connecting rod component 23 provided at the transverse bottom of the frame body 26'. The wheel connecting rod component 23 of the front frame 2' includes connecting arms 231 that each extend forward to a wheel frame 232 that is rotatably connected to at least one wheel or roller and the front forks 3'.

The batteries 22' each include a handle 222 and when installed, they interact with at least one pluggable component (not shown) which is inserted into an opening 27' for connection of at least one battery 22' to power the vehicle V. The transverse insertion scheme can be provided with two batteries 22', which has an advantage of providing a longer run life cycle time, reducing the likelihood that the vehicle V cannot be used due to failure of a battery or a charger, and ensuring the continuity of operation. Two batteries can be helpful in a work environment far away from a charging location when both are installed in the vehicle V. However, it will be appreciated that different battery loading and connection schemes, whether utilizing a single battery or a plurality of batteries may meet the requirements of different vehicles. In some embodiments, such as the one shown, a vehicle may accommodate a plurality of batteries but be able to operate with only one battery installed, if desired.

The rear frame 1 includes an operating handle 11, a handle joint base 14, a hydraulic component 12, a bearing component and a driving assembly 13 connected to a box body 139. In this example, the driving assembly 13 includes a motor 137 that drives a ground engaging driving wheel component 136 indirectly via gears. The bottom end of the operating handle 11 is rotatably connected to the handle joint base 14. The handle joint base 14 is connected to the hydraulic component 12 and the hydraulic component 12 includes an oil cylinder 121. The bearing component includes a bearing bridge 122. The middle part of the bearing bridge 122 is sleeved on the oil cylinder 121 and is rotatable relative to the oil cylinder 121. The oil cylinder 121 is fixedly connected with the top shaft head end 131 of the box body 139 of the driving assembly 13. A controller 133 is connected to the box body 139 of the rear frame 1'. Having the controller 133 installed on the box body 139 reduces the distance between the controller 133 and the driving motor 137, which reduces the length of the electrical cable (not shown for convenience in viewing the structures). This provides for better electrical wiring management and reduces the likelihood of cable over-flexing and electrical wiring interference.

A top 12' of the hydraulic component 12 may be removably connected to the front frame 2' by being plugged into a receptacle at the top of the frame body 26'. The bearing component includes a bearing bridge 122 and bridge lugs 123 may be connected to the ends of the bearing bridge 122 of the rear frame 1', or may be connected as shown, to the connecting arms 231 of the front frame 2'. Alternatively, the bridge lugs or similar structures may be integrally provided with the bearing bridge ends or the connecting arms. In this manner, both ends of the bearing bridge 122 of the rear frame 1' are quickly detachable from and connectable to the connecting arms 231 of the front frame 2' by use of conventional fasteners and/or alternative connectors and methods of connection. Insertion of the top 12' of the hydraulic component 12 into the receptacle at the top of the frame body 26' and the fasteners used to connect the ends of the bearing bridge 122 to the connecting arms 231 of the wheel connecting rod component 23 of the front frame 2' are the only structural connections required between the rear frame 1' and the front frame 2', with the only other connection being with respect to a wiring harness, which is not shown for convenience of viewing the structural components and may include one or more connectors.

Advantages of the example carriers of the present disclosure are provided by the technical scheme of the combination of the modularly assembled rear frame 1' and front frame 2', which are assembled to each other after shipping of the vehicle V, compared to existing carriers that are fully assembled during manufacturing and prior to shipping, often due to hydraulic system fluid connections that must be made between components in the front and rear frames. The present carriers are constructed as pallet truck vehicles V and to be more conveniently and quickly assembled, compact in structure, environmentally friendly, suitable for small tonnage transportation, and utilizing a new space and cost-efficient packing system 300 for shipping.

The rear frame 1' and front frame 2' are packed separately for knocked-down transportation. When a complete carrier needs to be assembled, the top 12' of the hydraulic component 12 is connected to the top of the front frame 2', then each end of the bearing bridge 122 of the rear frame 1' is connected to the wheel connecting rod component 23 of the front frame 2'. This may be via the bridge lugs 123 that are rotatably connected to corresponding connecting arms 231 and are further connected to ends of the bearing bridge 122. The battery structure in the form of one or more batteries 22' may be shipped in an installed condition, as shown, or may be packed separately within the packaging system. To use the vehicle V after shipping, the one or more batteries 22' must be in an installed position. The carrier thus may be quickly and conveniently final assembled after delivery of the separate rear frame 1' and front frame 2'.

Turning to FIGS. 2-18, a packing system 300 for shipping pallet truck vehicles V is disclosed wherein each vehicle V has a front frame 2' configured to be assembled to a rear frame 1'. The packing system 300 includes a first holder 400 that holds four vehicle rear frames 1', with each rear frame 1' lying on its side. This is best seen in FIGS. 2 and 4-12. The packing system 300 includes a second holder 500 that holds a first pair of vehicle front frames 2' having forks 3' with the first pair of front frames 2' in an upright configuration having the respective forks 3' stacked and facing in a first direction, and holds a second pair of vehicle front frames 2' having forks 3' with the second pair of front frames 2' in an inverted configuration having the respective forks 3' stacked and facing in an opposed second direction, and wherein the first holder 400 holding the four vehicle rear frames 1' is disposed within the second holder 500 vertically between the stacked forks 3' of the upright first pair of vehicle front frames 2' and the stacked forks 3' of the inverted second pair of vehicle front frames 2'. This can be appreciated when viewing FIGS. 2 and 9-12.

Figure 4:
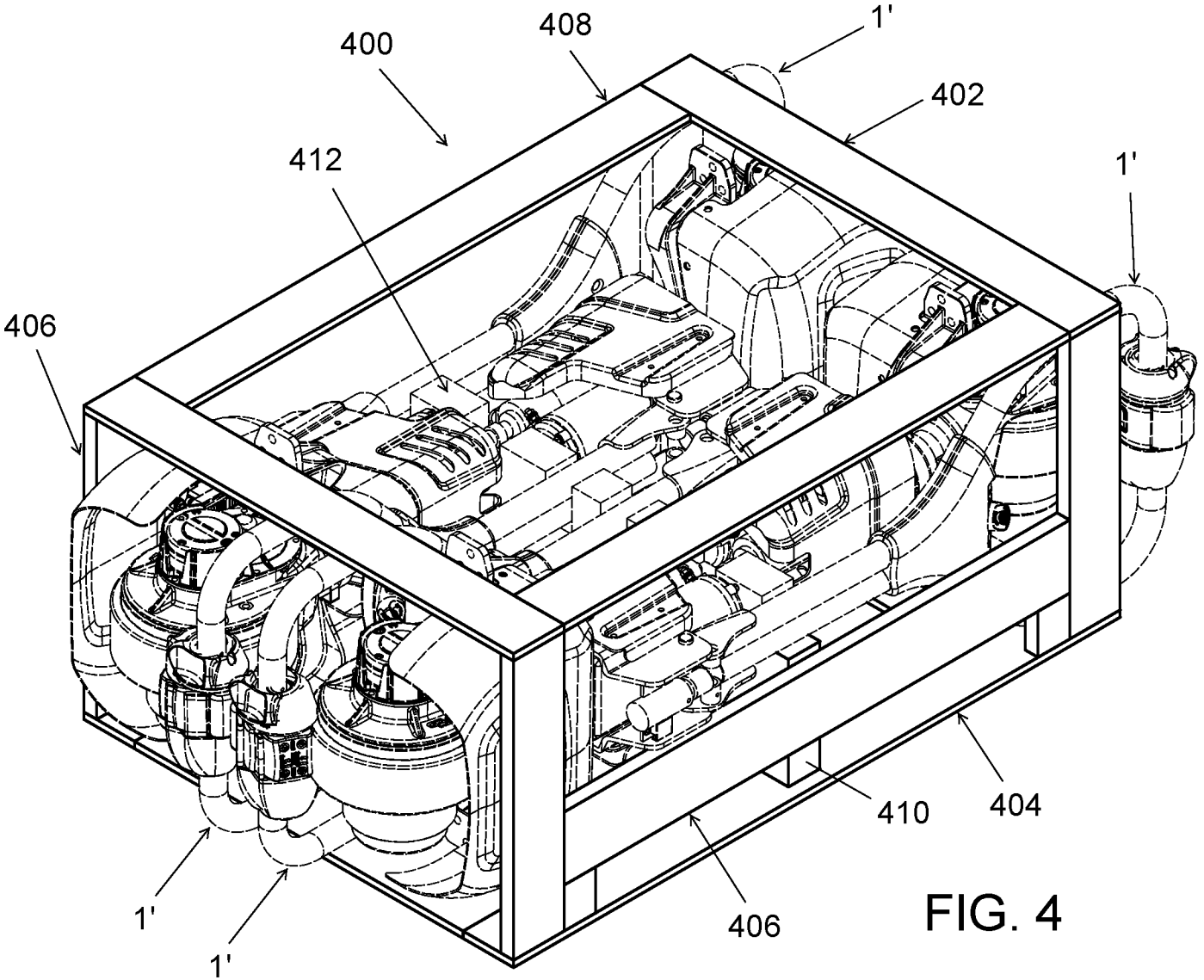
FIG. 4 is an upper perspective view of the four rear frames within the first holder shown in FIGS. 2 and 3.
Figure 5:
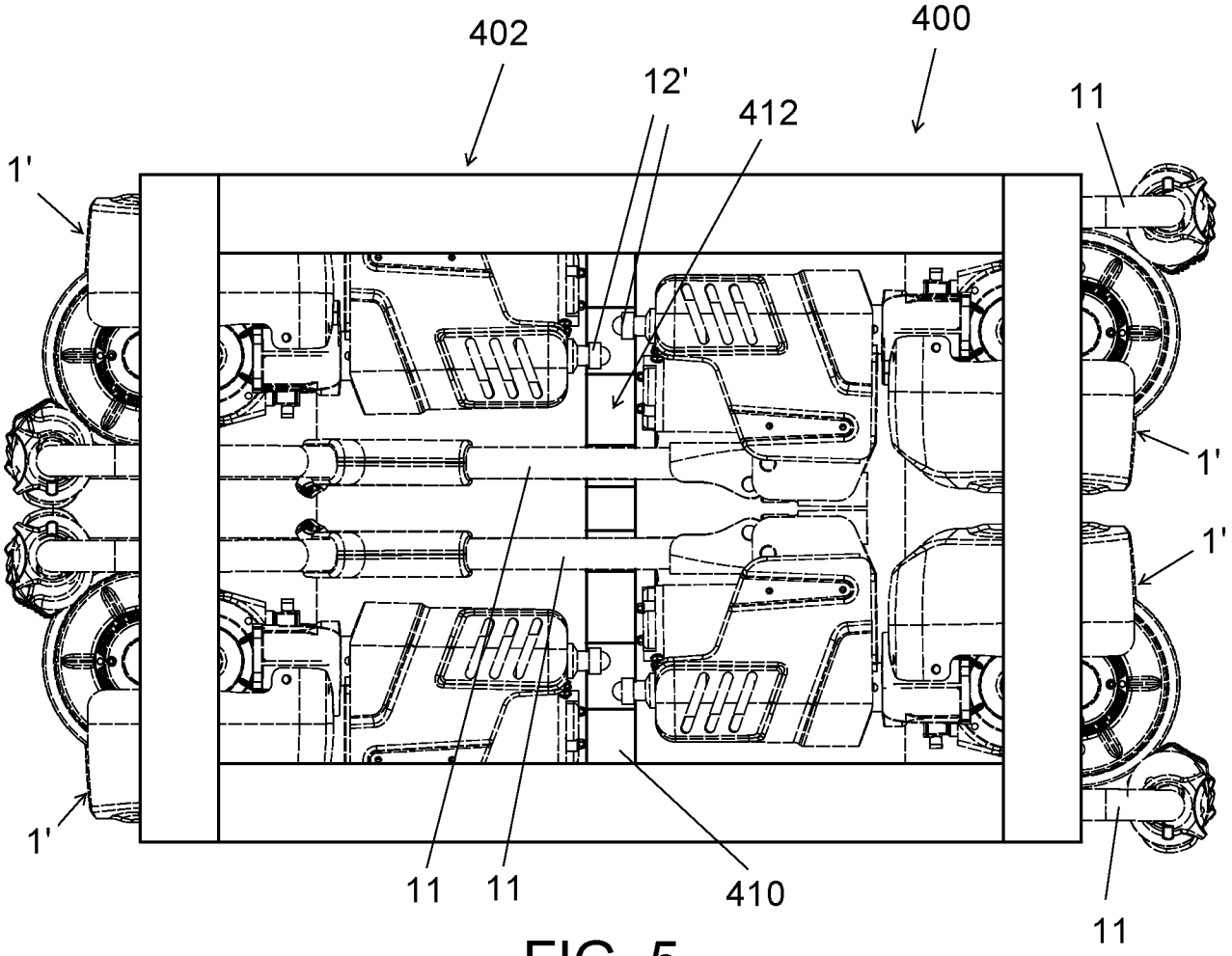
FIG. 5 is a top view of the four rear frames in the first holder shown in FIG. 4.
Figure 6:
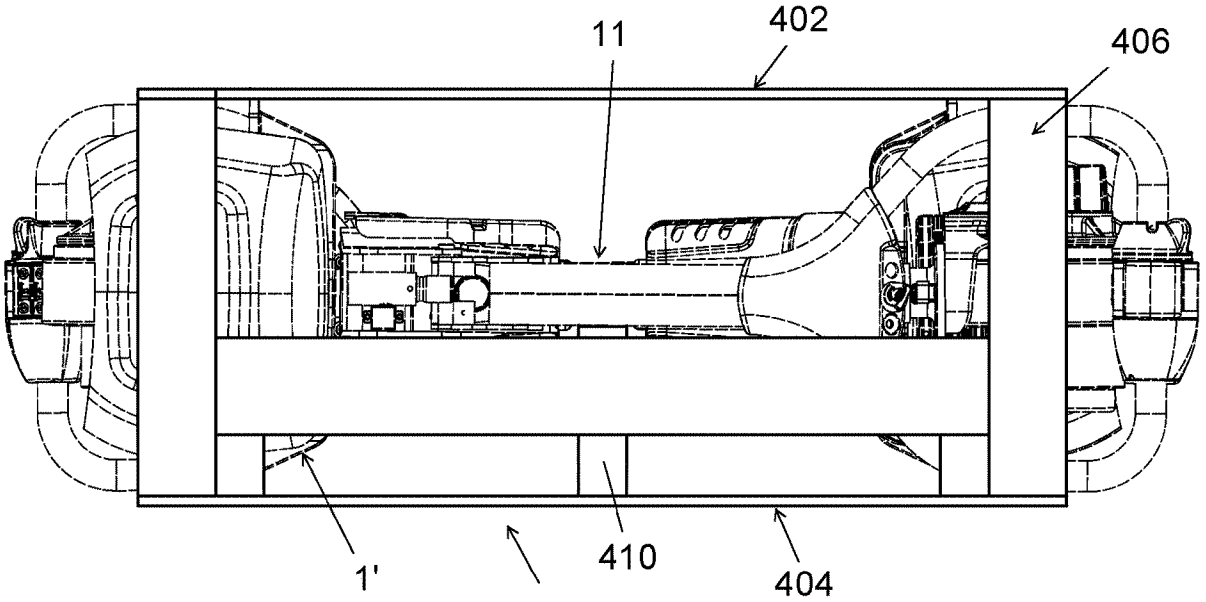
FIG. 6 is a side view of the four rear frames in the first holder shown in FIG. 4.
Figure 8:
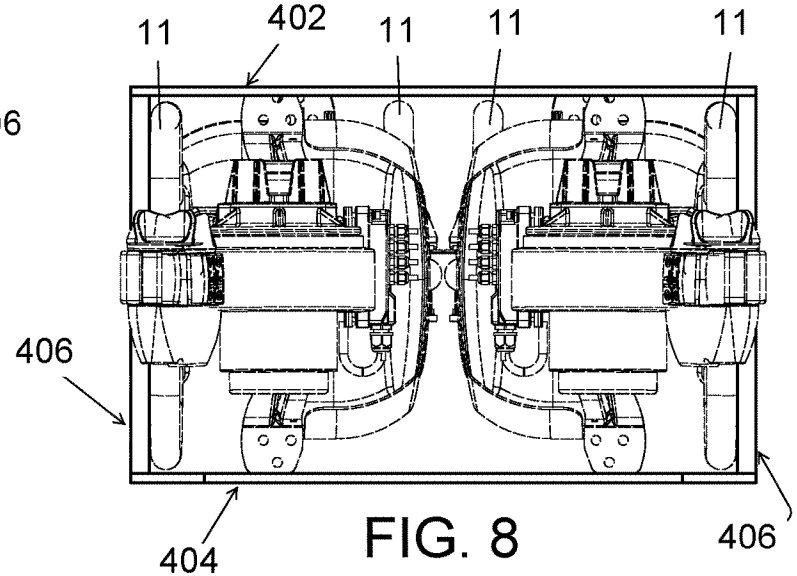
FIG. 8 is an opposed second end view of the four rear frames in the first holder shown in FIG. 4.
Figure 7:
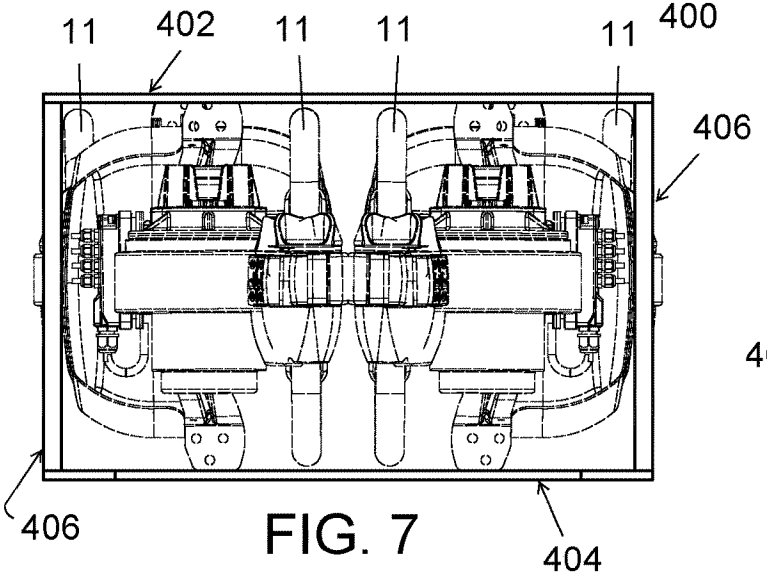
FIG. 7 is a first end view of the four rear frames in the first holder shown in FIG. 4.
Figure 9:
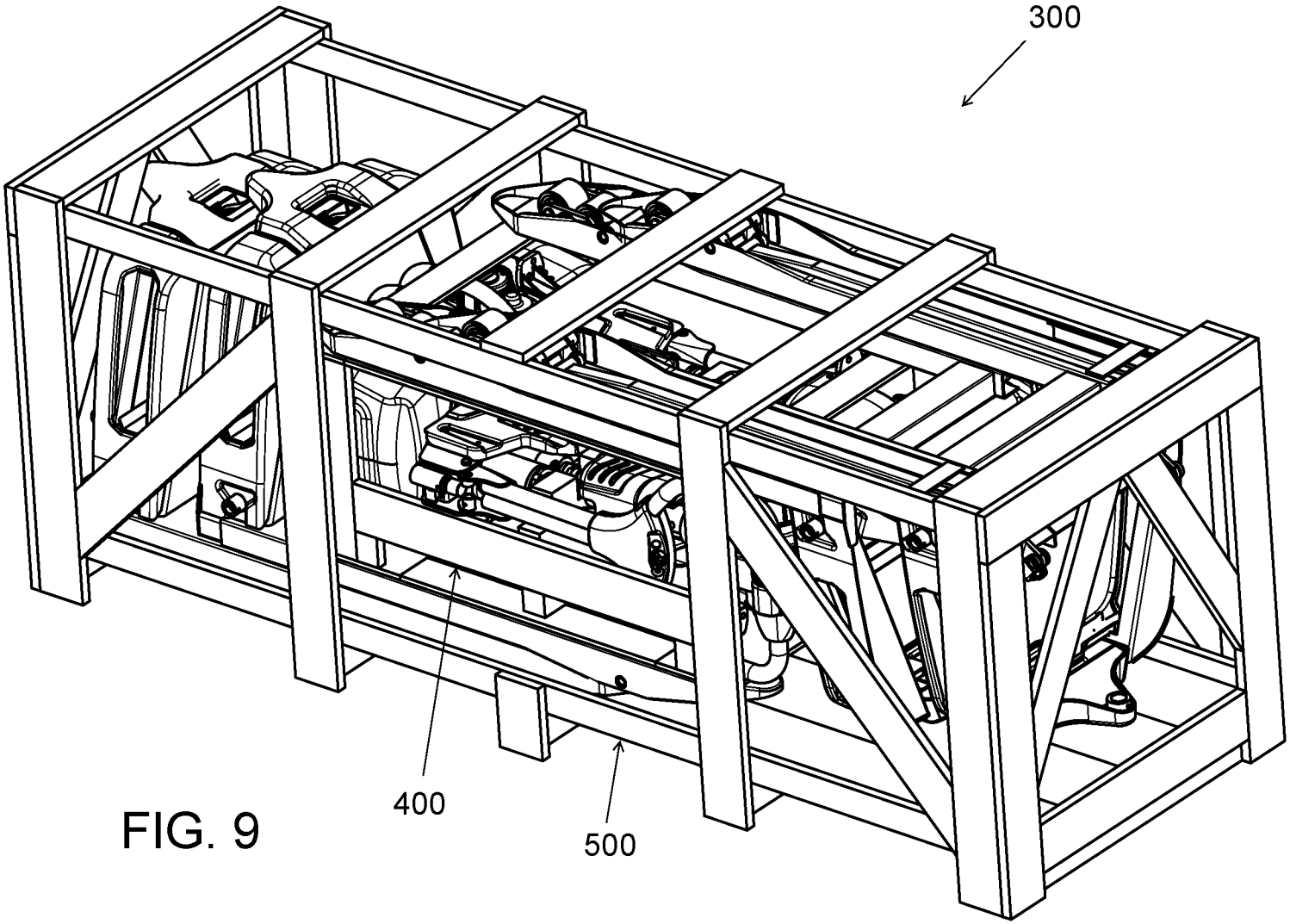
FIG. 9 is an upper perspective view from a first side of a packing system having four rear frames in a first holder held between four frames in a second holder in the configuration shown in FIG. 2.
Figure 10:
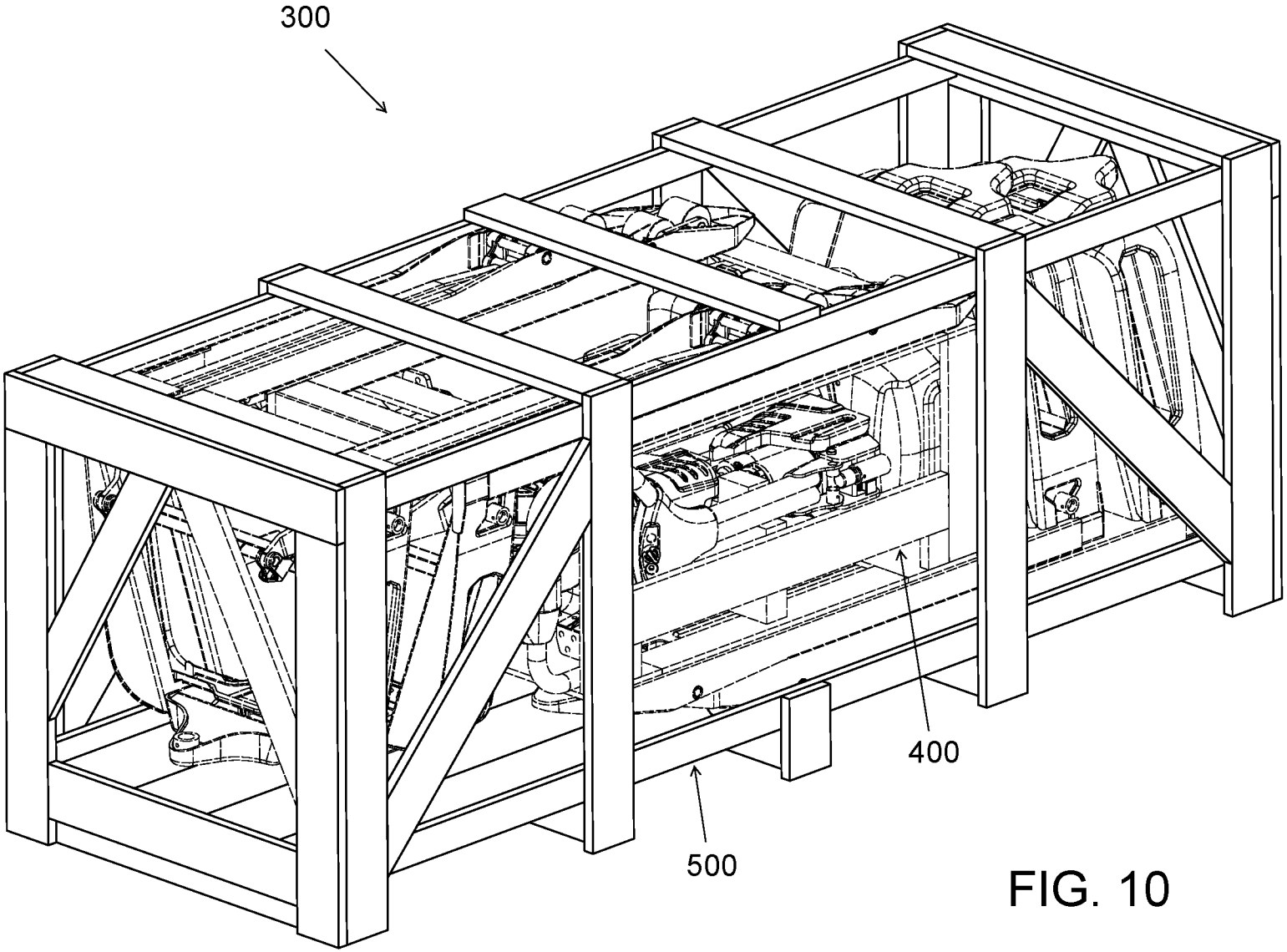
FIG. 10 is an upper perspective view from a second side of the packing system shown in FIG. 9.
Figure 11:
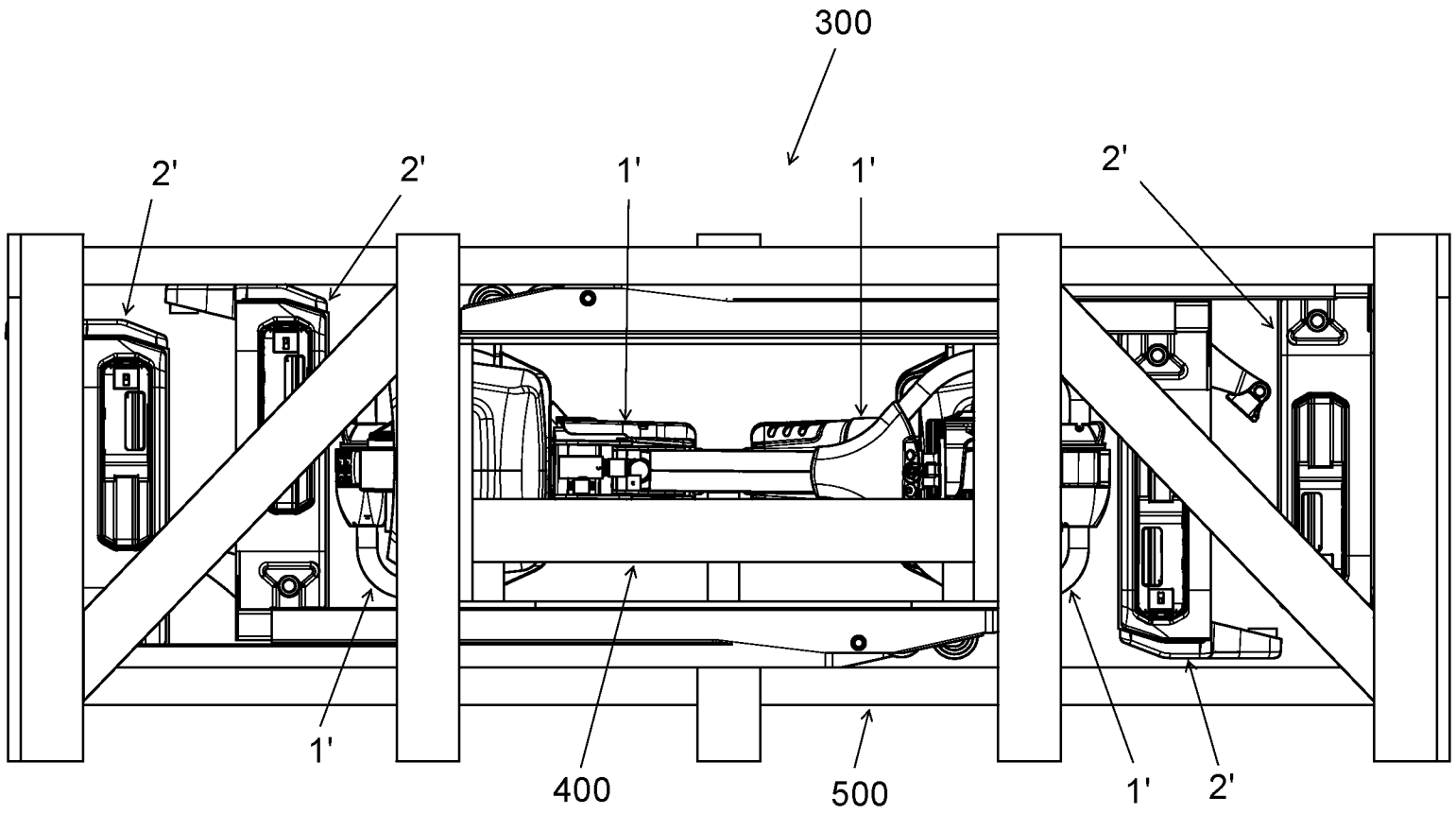
FIG. 11 is a side view from the first side of the packing system shown in FIG. 9.
Figure 12:
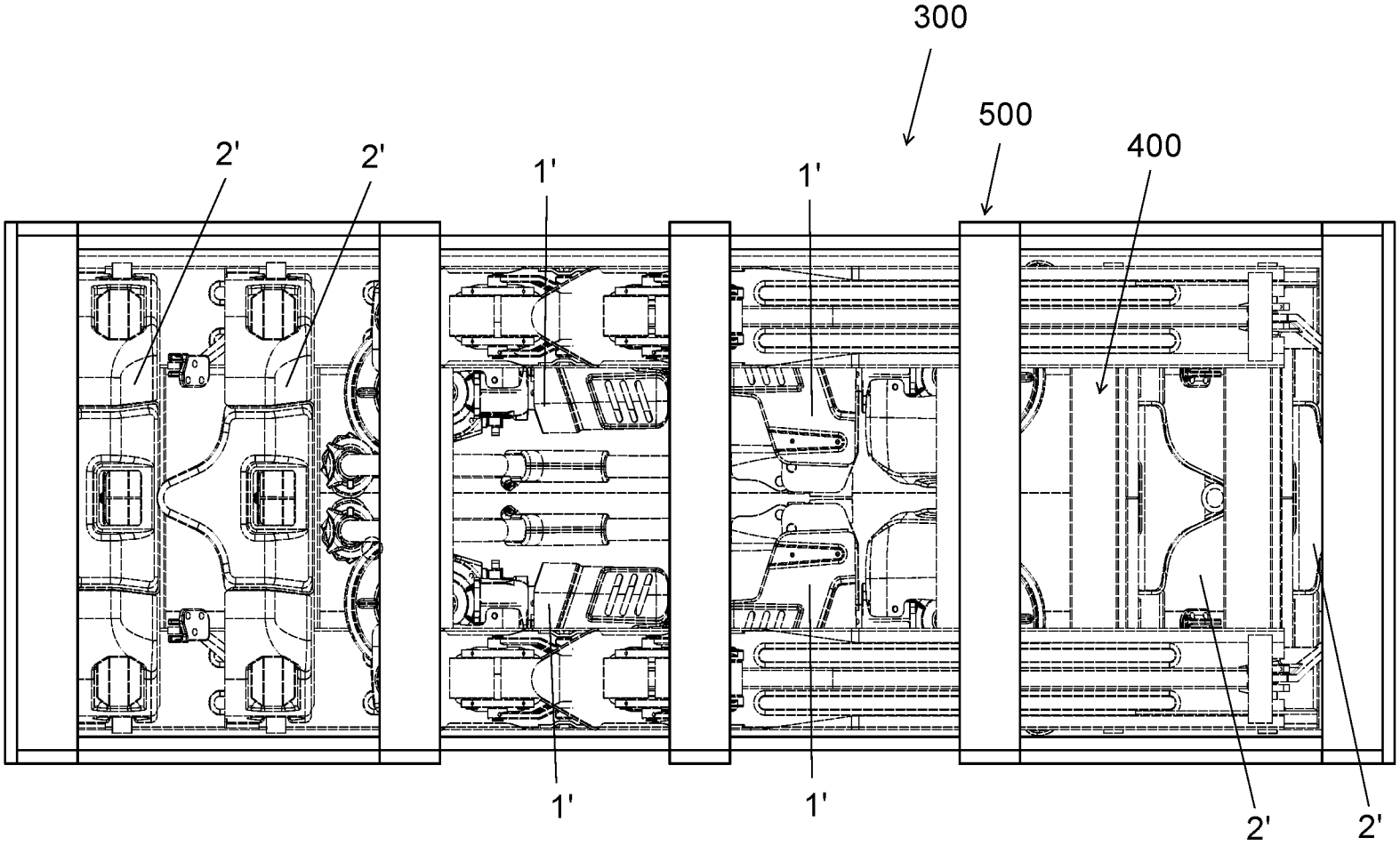
FIG. 12 is a top view of the packing system shown in FIG. 9.
Figure 14:
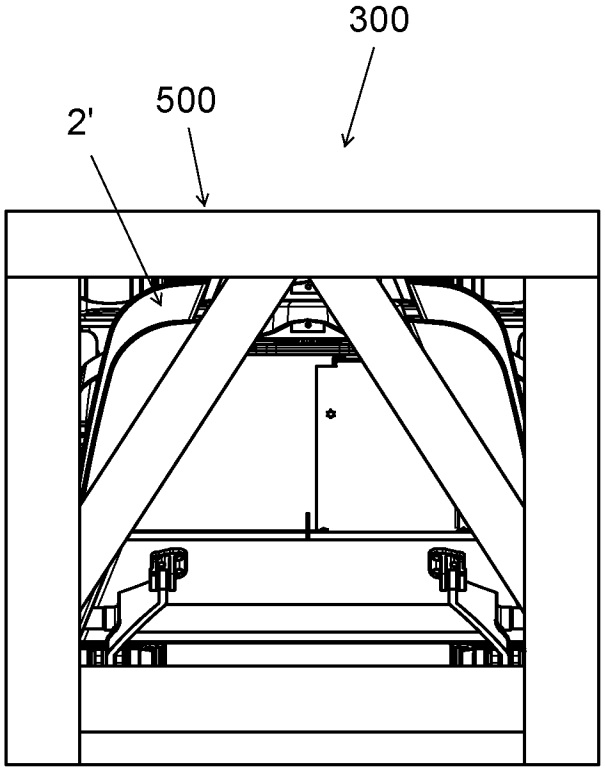
FIG. 14 is a second end view of the packing system shown in FIG. 9.
Figure 13:
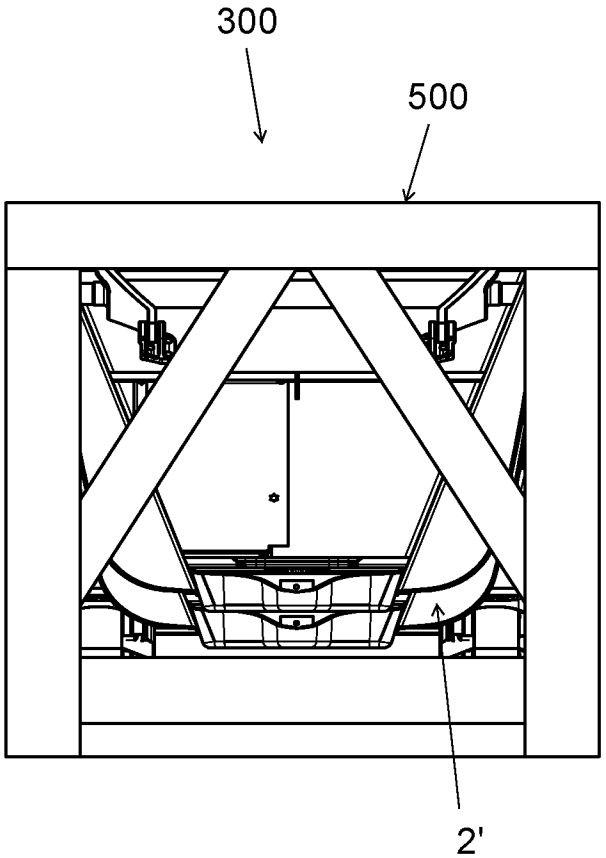
FIG. 13 is a first end view of the packing system shown in FIG. 9.
Figure 15:
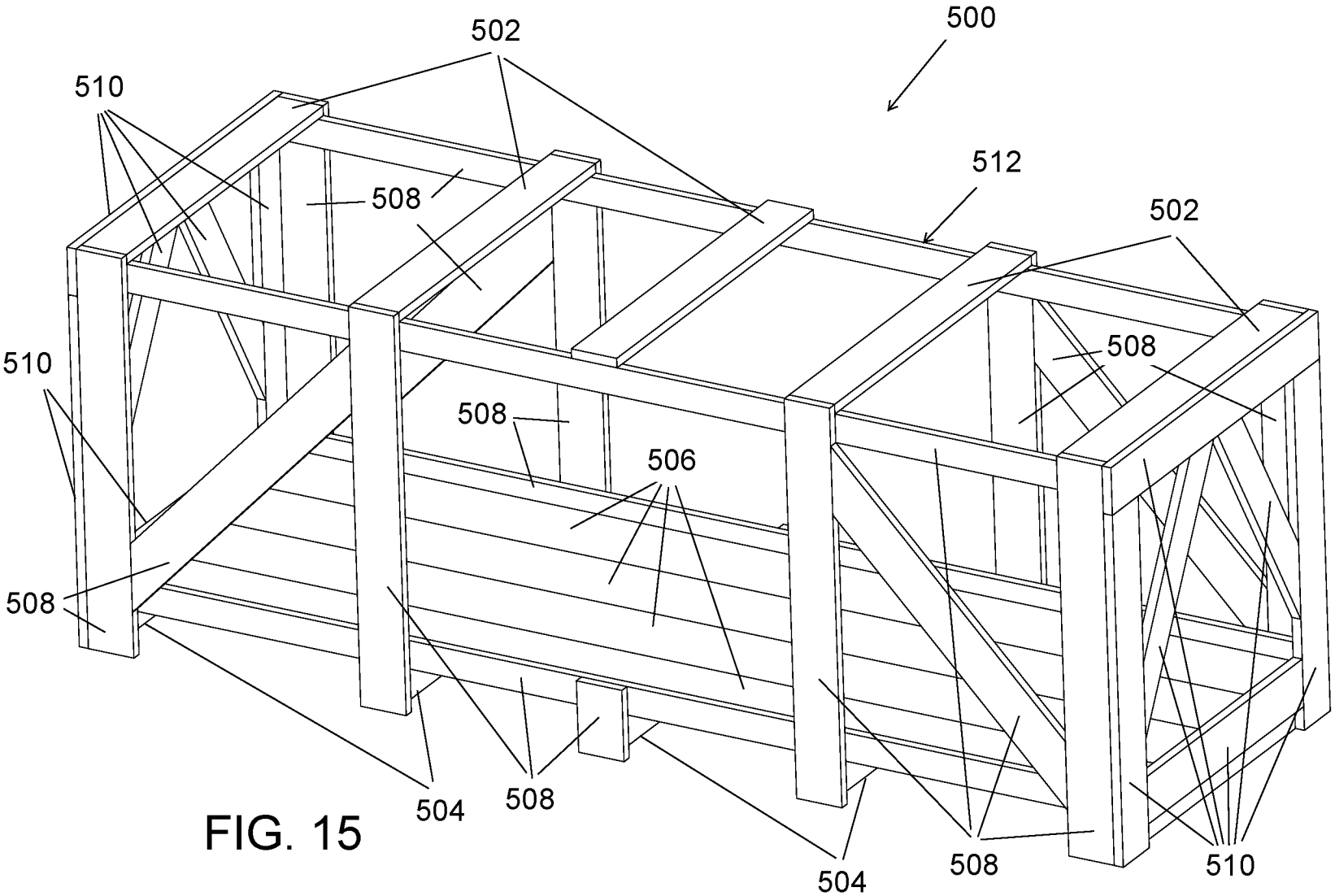
FIG. 15 is an upper perspective view from a first side of the second holder of the packing system shown in FIG. 9.
Figure 16:
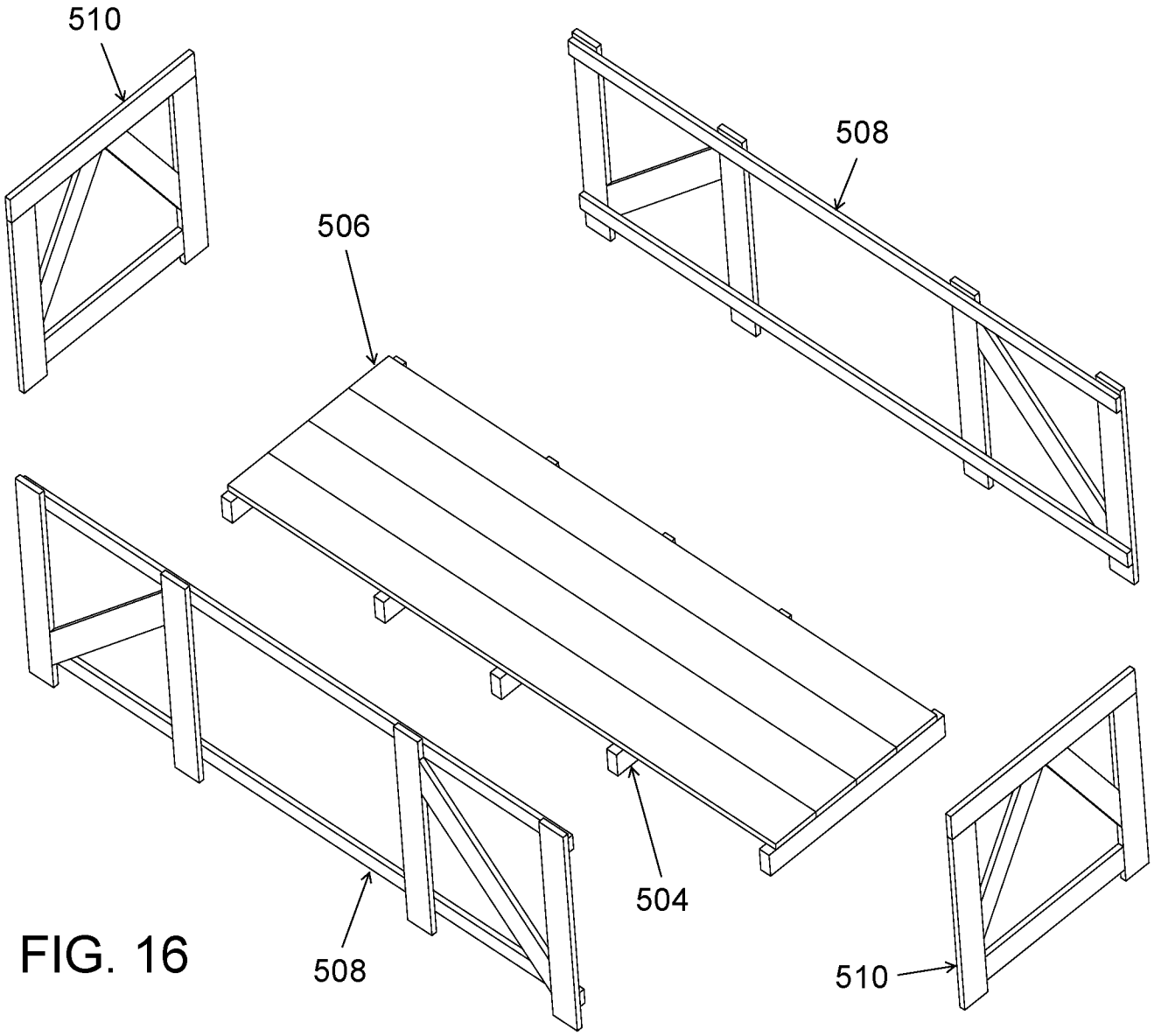
FIG. 16 is a partial exploded upper perspective view of the second holder shown in FIG. 15, with the top cross members removed for ease of viewing.

In the packing system 300, the first holder 400 also is disposed in the second holder 500 lengthwise between frame bodies 26' of the upright first pair of vehicle front frames 2' and frame bodies 26' of the inverted second pair of vehicle front frames 2'. As shown in FIGS. 4-6 and 9-12, the four rear frames 1' held by the first holder 400 are arranged lengthwise relative to the second holder 500 of the packing system 300. As best seen in FIGS. 4-6, the packing system 300 has the four rear frames 1' held by the first holder 400, which includes an inner pair of rear frames 2' adjacent each other and facing in opposed directions toward sides of the first and second holders 400, 500, and a second pair of rear frames 1' spaced apart, positioned adjacent the respective first pair of rear frames 1' and facing toward each other. In turn, as seen in FIGS. 4-5 and 7-8, the second pair of rear frames 1' is nestably stacked side-to-side relative to the first pair of rear frames 1'.

Figure 3:
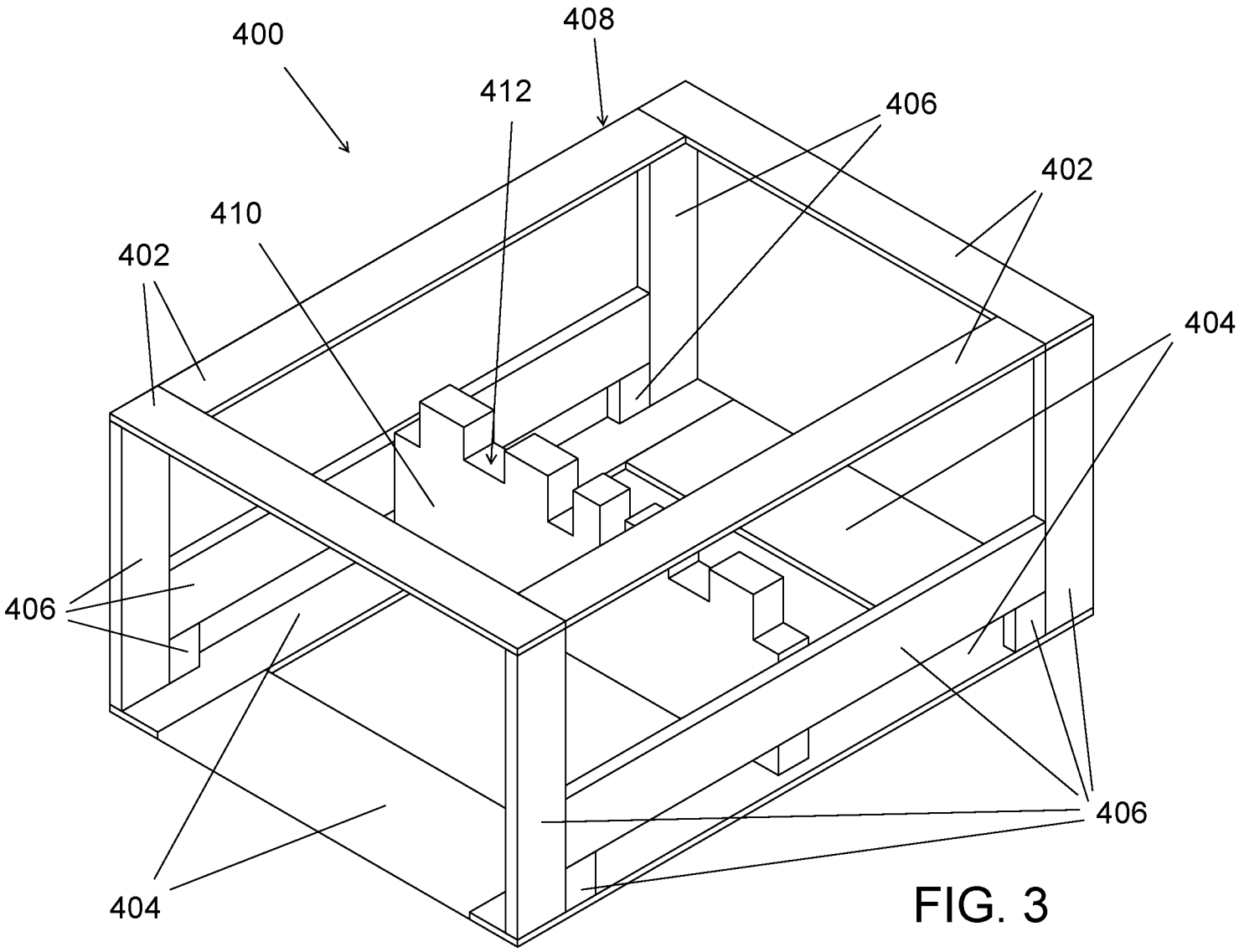
FIG. 3 is a perspective view of the first holder shown in FIG. 2.

Turning to the structure of the first holder 400 of the packing system 300, as shown in FIG. 3, the first holder has a top 402, a bottom 404 and opposed sides 406. In the example shown, the first holder 400 includes a first framework 408 configured as a crate having a first plurality of connected slats, which are used to construct the top 402, bottom 404 and opposed sides 406. The slats of the first holder 400 of this embodiment may, for example, be constructed of wood and nailed together or otherwise connected in a suitable matter. As best seen in FIGS. 3 and 4, the first holder 400 of the packing system 300 further includes a laterally extending, centrally located, upstanding support 410 that engages the four rear frames 1' held by the first holder 400, and may be connected thereto, such as by nailing, adhesives or by other suitable means. As described above, each of the four rear frames 1' includes a handle 11 and a top 12' of a hydraulic component 12, and as shown in FIG. 4, the laterally extending, centrally located, upstanding support 410 has a notched upper edge 412 that receives the handles 11 and tops 12' of the hydraulic components 12 of the four rear frames 1'. It will be appreciated that the first holder could be constructed of other materials, such as plastic slats and panels connected by stapling or adhesives. Still further, one may use corrugated or pressed cardboard structures, which may provide an open crate-like structure or may be entirely closed, for greater protection.

In turn, the second holder 500 includes a top 502, a bottom 504, a raised floor 506, opposed sides 508 and opposed ends 510. In the example shown, the second holder 500 includes a second framework 512 configured as a crate having a second plurality of connected slats, which are used to construct the top 502, bottom 504, raised floor 506, opposed sides 508 and opposed ends 510. The slats of the second holder 500 of this embodiment also may, for example, be constructed of wood and nailed together or otherwise connected in a suitable matter, or may be constructed of other suitable materials, as discussed with respect to the first holder 400. The raised floor 506 is spaced a distance above a ground surface.

The raised floor 506 of the second holder 500 supports the four front frames 2', and the first holder 400 that holds the four rear frames 1' and is disposed vertically between the stacked forks 3' of the upright first pair of vehicle front frames 2' and the stacked forks of the inverted second pair of vehicle front frames 2', as may be appreciated in FIGS. 2 and 9-12. Thus, the raised floor 506 not only provides a surface on which to rest the upright first stacked pair of front frames 2', but also may be utilized in lifting and moving the packing system 300, such as by engagement with forks of a fork truck or pallet truck.

The space efficient packing system 300 provides a significant advantage over shipping configurations for conventional pallet truck vehicles. Typical pallet truck vehicles are fully assembled and a pair of vehicles may face each other with their front forks interleaved. As such, the pair have a collective length that includes the length of a first fully assembled vehicle plus the length of the frame body and connected rear frame and handle of a second fully assembled vehicle. This conventional interleaved arrangement for shipping also has a width equal to the width of a first fully assembled vehicle plus a fork of the second fully assembled vehicle. If the pair of fully assembled vehicles sat side-by-side, then the width of the two simply would be twice the width of the first fully assembled vehicle. The height of the pair of fully assembled vehicles typically would be established by the height of the operator's handle when in an upright position.

The packing system 300 shown in the figures includes the second holder 500 having a length that is less than a length of two pallet truck vehicles V when each vehicle has the front frame 2' assembled to the rear frame 1' and the two vehicles V are in an upright position, facing each other and with the forks 3' of the two vehicles V interleaved and adjacent each other. Utilizing the packing system 300 results in the second holder 500 having a width that is less than a width of two pallet truck vehicles V when each vehicle has the front frame 2' assembled to the rear frame 1' and the two vehicles V are in an upright position, facing each other and with the forks 3' of the two vehicles V interleaved and adjacent each other. This is due in part to the front frames 2' being nestably stacked in pairs, with one pair in an upright stacked position and the other pair in an inverted stacked position. Each rear frame 1' includes a handle 11, and the second holder 500 of the packing system 300 has a height that is less than a height of one of the pallet truck vehicles V when the front frame 2' is assembled to the rear frame 1' and the vehicle V and handle 11 are in an upright position. This can be appreciated by the fact that rear frames 1' are packed on their sides in the first holder 400 and positioned vertically between the front frames 2' in the second holder 500.

Figure 17:
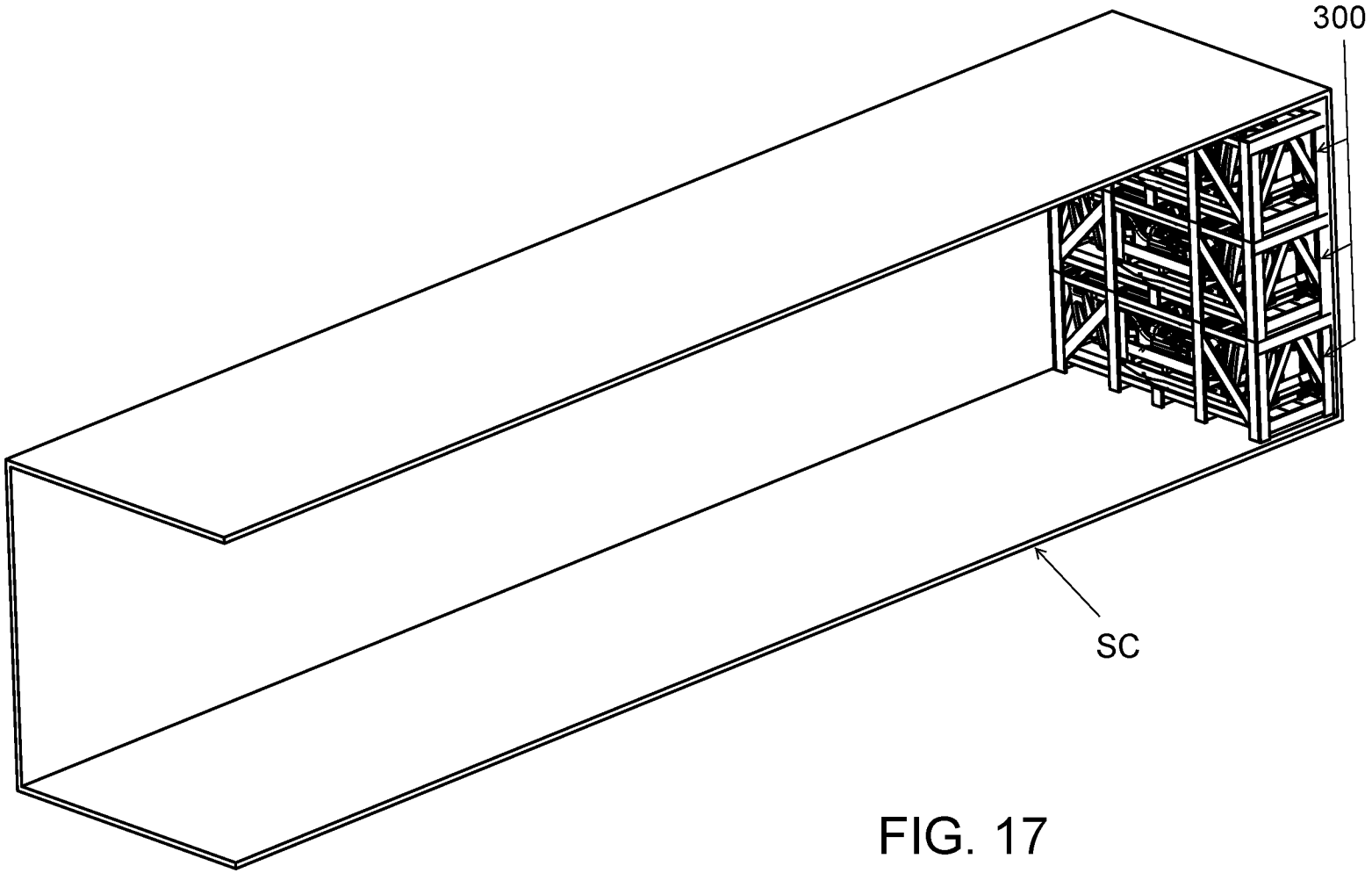
FIG. 17 is an upper perspective schematic diagram showing three stacked packing systems of FIG. 9 at a front end of a standard shipping container, with the shipping container having a right side wall and rear end removed for ease of viewing.
Figure 18:
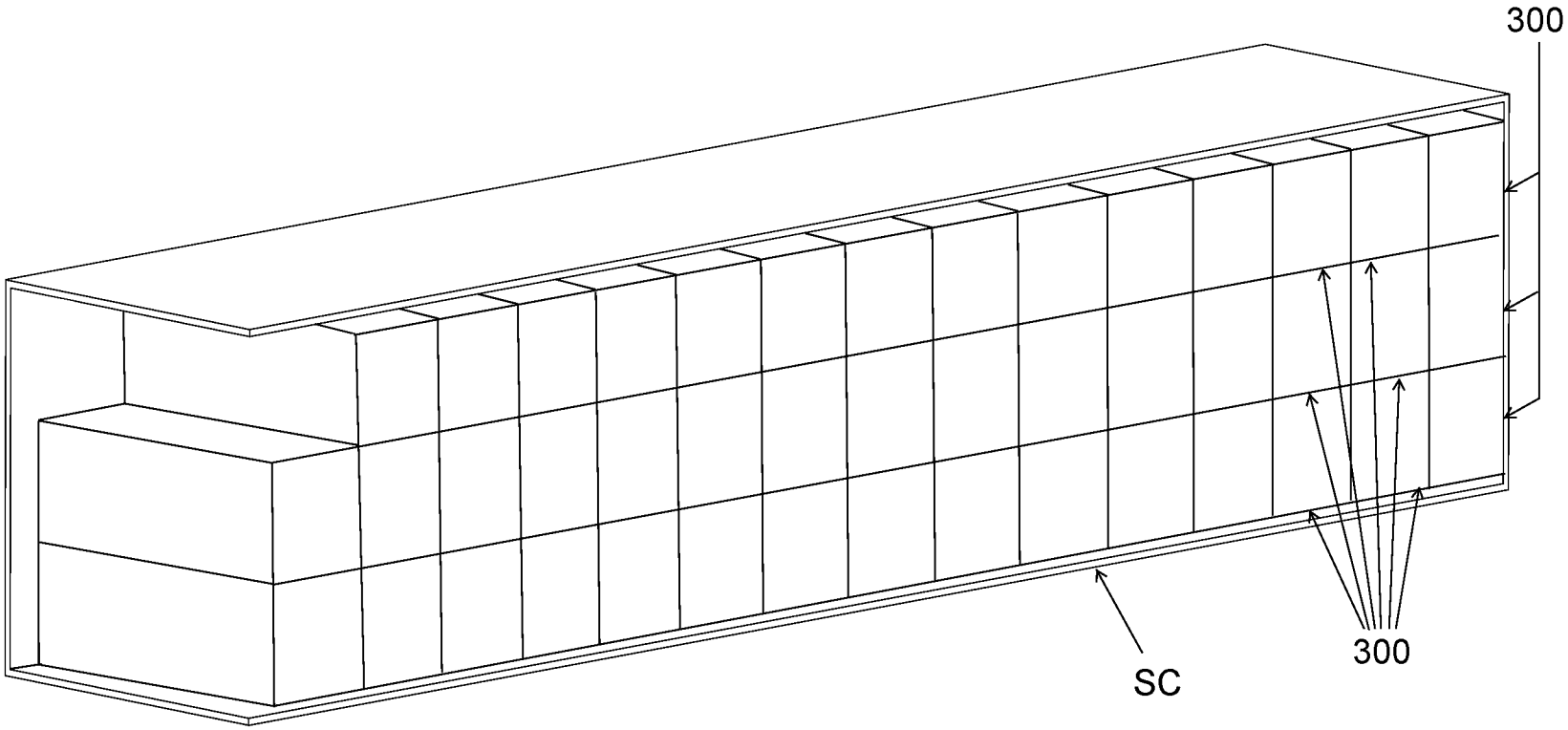
FIG. 18 is a simplified perspective schematic diagram showing that fifteen sets of three stacked packing systems of FIGS. 9 and 17 fit within a standard shipping container, with the shipping container having the right side wall and the rear end removed for ease of viewing.

Another significant advantage of the present packing system 300 is that a plurality of like packing systems 300 are stackable directly atop each other, as shown in FIG. 17. The rear frames 1' are nestably stacked on their sides within a first holder 400, with the first holder 400 protected by being located between the upright and inverted stacked front frames 2' within the second holders 500. Given the like box shape and placement of structural elements, such as the slats, within the second holders 500, the densely packed packing systems 300 are self-supporting. As such, three like packing systems 300 each having a size of 780 mm (30.7 inches) wide by 2300 mm (90.6 inches) long by 844 mm (32.3 inches) high, are stackable directly atop each other. Depending on the height of a shipping container SC, the three stacked packing systems 300 may be accommodated within the shipping container SC, such as a standard container SC having a size of approximately 2438 mm (8 feet) wide by 12,192 mm (40 feet) long by 2591 mm (8.5 feet) high, which is commonly used for international shipping. In turn, this will permit such a shipping container SC to hold fifteen sets of like packing systems 300 stacked directly atop each other and placed from front to rear, with the rearmost set being stacked only two high, per the diagram in FIG. 18, to accommodate the shipping container SC door hardware. In other words, the standard shipping container is able to accommodate 44 packing systems 300, each of which holds 4 vehicles V, for a total of 176 vehicles V per standard shipping container SC. It will be appreciated that other shipping container dimensions may apply while the present packing system and method would still provide an advantageous benefit.

Thus, the disclosure has demonstrated packing systems 300 wherein each vehicle V to be shipped includes a front frame 2' that includes a frame body 26' providing for removable installation of at least one battery 22', and a wheel connecting rod component 23 provided transversely at the bottom of the frame body 26', with the wheel connecting rod component 23 further comprising connecting arms 231 at the rear of the wheel connecting rod component 23 and being connected to wheel frames 232 near front forward extending forks 3' of the front frame 2'. Each vehicle V also has a rear frame 1' that includes an operating handle 11, a handle joint base 14, a hydraulic component 12, a bearing component having a bearing bridge 122 and a driving assembly 13. It is preferred that each rear frame 1' further includes a controller 133. In accordance with the above description, for each vehicle V the front frame 2' may be separated from the rear frame 1' for shipping, while remaining ready to assemble structurally by connecting a top of a hydraulic component 12 of the rear frame 1' to the front frame 2' and connecting ends of a bearing bridge 122 of the rear frame 1' to a wheel connecting rod component 23 of the front frame 2'.

The innovation of this assembly method includes on one hand, the carrier being divided into two parts, the rear frame 1' and front frame 2', for synchronous assembly and separate packaging with no fluid connections required between the rear frame 1' and the front frame 2'. This improves the production efficiency of assembly and is convenient and efficient when packing for shipping. On the other hand, it changes the assembly and sales mode of existing carriers, that is, in the process of assembly and sales, because existing carriers generally are assembled into a whole vehicle in factories, and then transported and sold in the form of a whole vehicle. In the present novel technical scheme, the rear frame 1' and front frame 2' are assembled in a factory and optionally may be tested to be qualified in performance, respectively, and then packed in the novel packing system 300 for sale and shipment. The vehicles V may be shipped in a more space and cost-efficient packing system 300. Thereafter, the buyer can assemble the two parts to form a whole vehicle V, which is simple and quick to assemble. Of course, it also can be assembled into a whole vehicle in a factory and then sold.

The present disclosure includes a method of packing pallet truck vehicles in a packing system for shipment. The method comprises the steps of: providing a plurality of pallet truck vehicles, with each vehicle having a front frame separated from and configured to be assembled to a rear frame; loading the rear frames of the plurality of vehicles in a first holder that holds each rear frame lying on a side thereof; loading the plurality of front frames in a second holder that holds at least one front frame having forks with the at least one front frame in an upright configuration having the forks of the at least one front frame facing in a first direction, and holds at least a second front frame having forks with the at least second front frame in an inverted configuration having the forks of the at least second front frame facing in an opposed second direction; and wherein the first holder holding the plurality of rear frames is disposed within the second holder vertically between the forks of the upright at least one first front frame and the forks of the inverted at least one second front frame.

In the example shown in FIGS. 2, 4 and 9-12, four vehicles V having respective rear frames 1' and front frames 2' are packed within a packing system 300 having a first holder 400 and second holder 500. However, it will be appreciated that the vehicles may have variations in their structures and that the packing systems and methods of the present disclosure may include a plurality of vehicles V that would include fewer than or more than four vehicles V. For instance, three vehicles may be packed within a packing system by having a pair of front frames 2' stacked in an upright position within a second holder 500, with one front frame 2' held within the second holder 500 in an inverted position, and a first holder 400 holding three rear frames 1' between the forks of the upright and inverted front frames 2'. With three vehicles V, the front frames 2' may be alternatively arranged to have one front frame 2' held in an upright position in a second holder 500, two front frames held in an inverted position in the second holder 500, and a first holder 400 holding three rear frames 1' between the forks of the upright and inverted front frames 2'.

Thus, the method of packing pallet truck vehicles in a packing system for shipment may further include wherein the step of loading the plurality of front frames in a second holder further comprises stacking at least two front frames in an upright configuration wherein the respective forks of the at least two front frames are vertically stacked. The example embodiment in the drawings includes at least two front frames in an upright stacked configuration. The method also may further include wherein the step of loading the plurality of front frames in a second holder further comprises stacking at least two front frames in an inverted configuration wherein the respective forks of the at least two front frames are vertically stacked. The example embodiment in the drawings also includes at least two front frames in an inverted stacked configuration.

Those skilled in the art will appreciate that the embodiments of the present disclosure described above and shown in the drawings are only taken as examples and do not limit the claims of the present application. The functions and structural principles of the present disclosure have been shown and explained in the embodiments, and the implementation may be modified without deviating from the principles of the disclosure.

The invention claimed is:

1. A packing system for shipping pallet truck vehicles wherein each vehicle has a front frame configured to be assembled to a rear frame, the packing system comprising:

a first holder that holds four vehicle rear frames, with each rear frame lying on its side;

a second holder that holds a first pair of vehicle front frames having forks with the first pair of front frames in an upright configuration having the respective forks stacked and facing in a first direction, and holds a second pair of vehicle front frames having forks with the second pair of front frames in an inverted configuration having the respective forks stacked and facing in an opposed second direction; and wherein the first holder holding the four vehicle rear frames is disposed within the second holder vertically between the stacked forks of the upright first pair of vehicle front frames and the stacked forks of the inverted second pair of vehicle front frames.

2. The packing system for shipping pallet truck vehicles according to claim 1, wherein the first holder also is disposed in the second holder lengthwise between frame bodies of the upright first pair of vehicle front frames and frame bodies of the inverted second pair of vehicle front frames.

3. The packing system according to claim 1, wherein the four rear frames held by the first holder are arranged lengthwise relative to the second holder.

4. The packing system according to claim 3, wherein the four rear frames held by the first holder comprise an inner pair of rear frames adjacent each other and facing in opposed directions toward sides of the first and second holders and a second pair of rear frames spaced apart, positioned adjacent the respective first pair of rear frames and facing toward each other.

5. The packing system according to claim 4, wherein the second pair of rear frames is nestably stacked side-to-side relative to the first pair of rear frames.

6. The packing system according to claim 1, wherein the first holder comprises a top, a bottom and opposed sides.

7. The packing system according to claim 6, wherein the first holder further comprises a first framework configured as a crate having a first plurality of connected slats.

8. The packing system according to claim 7, wherein the second holder comprises a second framework having a top, a bottom, opposed sides and opposed ends.

9. The packing system according to claim 8, wherein the second framework is configured as a crate having a second plurality of connected slats.

10. The packing system according to claim 8, wherein the second holder comprises a raised floor that is spaced a distance above a ground surface.

11. The packing system according to claim 10, wherein the raised floor supports the four front frames and the first holder holds the four rear frames and is disposed vertically between the stacked forks of the upright first pair of vehicle front frames and the stacked forks of the inverted second pair of vehicle front frames.

12. The packing system according to claim 1, wherein the first holder further comprises a laterally extending, centrally located, upstanding support that engages the four rear frames held by the first holder.

13. The packing system according to claim 12, wherein each of the four rear frames further comprises a handle and a top of a hydraulic component, and the laterally extending, centrally located, upstanding support has a notched upper edge that receives the handles and tops of the hydraulic components of the four rear frames.

14. The packing system according to claim 1, wherein the second holder has a length that is less than a length of two pallet truck vehicles when each vehicle has the front frame assembled to the rear frame and the two vehicles are in an upright position, facing each other and with the forks of the two vehicles interleaved and adjacent each other.

15. The packing system according to claim 14, wherein the second holder has a width that is less than a width of two pallet truck vehicles when each vehicle has the front frame assembled to the rear frame and the two vehicles are in an upright position, facing each other and with the forks of the two vehicles interleaved and adjacent each other.

16. The packing system according to claim 1, wherein each rear frame further comprises a handle, and the second holder has a height that is less than a height of one of the pallet truck vehicles when the front frame is assembled to the rear frame and the vehicle and the handle are in an upright position.

17. The packing system according to claim 1, wherein a plurality of the packing systems are stackable directly atop each other.

18. The packing system according to claim 17, wherein three of the packing systems are stackable directly atop each other within a shipping container.

19. The packing system according to claim 18, wherein the shipping container holds fifteen sets of three of the packing systems stacked directly atop each other.

20. The packing system according to claim 1, wherein each vehicle comprises a front frame that includes a frame body that provides for removable installation of at least one battery, and a wheel connecting rod component provided transversely at the bottom of the frame body, with the wheel connecting rod component further comprising connecting arms at the rear of the wheel connecting rod component and being connected to wheel frames near front forward extending forks of the front frame.

21. The packing system according to claim 1, wherein the rear frame of each vehicle comprises an operating handle, a handle joint base, a hydraulic component, a bearing component having a bearing bridge and a driving assembly.

22. The packing system according to claim 21, wherein each rear frame further comprises a controller.

23. The packing system according to claim 1, wherein for each vehicle the front frame may be separated from the rear frame for shipping, while remaining ready to assemble structurally by connecting a top of a hydraulic component of the rear frame to the front frame and connecting ends of a bearing bridge of the rear frame to a wheel connecting rod component of the front frame.

24. A method of packing pallet truck vehicles in a packing system for shipment, comprising the steps of:

providing a plurality of pallet truck vehicles, with each vehicle having a front frame separated from and configured to be assembled to a vehicle rear frame;

loading the rear frames of the plurality of vehicles in a first holder that holds each rear frame lying on a side thereof;

loading the plurality of front frames in a second holder that holds at least one front frame having forks with the at least one front frame in an upright configuration having the forks of the at least one front frame facing in a first direction, and holds at least a second front frame having forks with the at least second front frame in an inverted configuration having the forks of the at least second front frame facing in an opposed second direction; and wherein the first holder holding the plurality of rear frames is disposed within the second holder vertically between the forks of the upright at least one first front frame and the forks of the inverted at least one second front frame.

25. The method of packing pallet truck vehicles in a packing system for shipment according to claim 24, further comprising:

wherein the step of loading the plurality of front frames in a second holder further comprises stacking at least two front frames in an upright configuration wherein the respective forks of the at least two front frames are vertically stacked.

26. The method of packing pallet truck vehicles in a packing system for shipment according to claim 24, further comprising:

wherein the step of loading the plurality of front frames in a second holder further comprises stacking at least two front frames in an inverted configuration wherein the respective forks of the at least two front frames are vertically stacked.

* * * * *